US005653669A

United States Patent [19]

Cheng

[11] Patent Number: 5,653,669

[45] Date of Patent: Aug. 5, 1997

[54] UNIVERSAL GYM WITH UNIFORM RESISTANCES

[76] Inventor: Chang Lee Cheng, 11F-2, No. 17 Sanchung Rd., Taichung, Taiwan

[21] Appl. No.: 589,270

[22] Filed: Jan. 22, 1996

[51] Int. Cl.[6] ..... A63B 21/00

[52] U.S. Cl. ..... 482/138; 482/8; 482/134; 482/112; 482/136

[58] Field of Search ..... 482/8, 99, 92, 482/133, 134, 138, 139, 100, 112, 136

[56] References Cited

U.S. PATENT DOCUMENTS

| | | | |
|---|---|---|---|
| 4,900,018 | 2/1990 | Ish, III et al. | 482/138 |
| 5,120,289 | 6/1992 | Yu | 482/138 |
| 5,221,245 | 6/1993 | Yeh | 482/138 |
| 5,230,680 | 7/1993 | Wu | 482/138 |
| 5,263,915 | 11/1993 | Habing | 482/138 |
| 5,290,214 | 3/1994 | Chen | 482/138 |
| 5,316,534 | 5/1994 | Dalebout et al. | 482/138 |
| 5,336,153 | 8/1994 | Chen | 482/99 |
| 5,518,477 | 5/1996 | Simonson | 482/138 |

*Primary Examiner*—Richard J. Apley
*Assistant Examiner*—Victor K. Hwang
*Attorney, Agent, or Firm*—Charles E. Baxley

[57] ABSTRACT

A universal gym includes a frame assembly, a resistance assembly, a lever-type strain gauge, and a plurality of exercising assemblies the resultant resistances of which are identical under proper arrangement of a plurality of movable pulleys and fixed pulleys.

7 Claims, 8 Drawing Sheets

UNIVERSAL GYM WITH UNIFORM RESISTANCES

BACKGROUND OF THE INVENTION

1. Field of the Invention

The present invention relates to a universal gym with uniform resistance and, more particularly, to a universal gym in which an user is subjected to identical resistance when using a plurality of exercising assemblies thereof.

2. Description of the Related Art

A universal gym is a popular indoor exercising device which allows modern people to achieve physical fitness and generally includes a resistance means, a plurality of exercising assemblies for, e.g., training muscles of arms and legs of the exercisers, and a plurality of transmitting members provided between the resistance means and the exercising assemblies. Although a wide variety of universal gyms have heretofore been provided, a common drawback therebetween is that the resulting resistances of the exercising assemblies are different from each other, e.g., an exerciser may encounter a relatively large resistance when using one exercising assembly of the gym and encounter a relatively small resistance when using another exercising assembly. As a result, the exerciser may be injured if not aware of the change in the resistance.

Therefore, there has been a long and unfulfilled need for an improved universal gym to mitigate and/or obviate the above problem.

SUMMARY OF THE INVENTION

A universal gym in accordance with the present invention comprises a frame assembly, a resistance means, and a plurality of exercising assemblies including an arm exercising assembly, a chest exercising assembly, and a leg exercising assembly.

The frame assembly comprises a lower subframe, two spaced vertical beams projecting upwardly from the lower subframe, and an upper subframe securely mounted to tops of the vertical beams. An inclined board is mounted between the lower subframe and the upper subframe, and a seat is fixedly attached to a lower section of the inclined board.

A first fixed pulley is securely mounted to an upper side of the upper subframe and adjacent to the arm exercising assembly. A second fixed pulley is securely mounted to the upper side of the upper subframe and distal to the arm exercising assembly. A third fixed pulley and a fourth fixed pulley are securely mounted between mediate sections of the upright beams. A fifth fixed pulley is mounted to an underside of the upper subframe and between the first and second fixed pulleys.

A first movable pulley pair includes an upper movable pulley and a lower movable pulley and provided between the fourth fixed pulley and the fifth fixed pulley. A second movable pulley pair includes an upper movable pulley and a lower movable pulley provided between the fifth fixed pulley and the resistance means. A pair of sixth fixed pulleys is securely mounted to the upper side of the upper subframe and respectively on both sides of the second fixed pulley. A seventh fixed pulley is securely mounted to the lower subframe. A movable pulley is provided between the sixth fixed pulleys and the seventh fixed pulley. A third movable pulley pair includes an upper pulley and a lower pulley provided between the movable pulley and the seventh fixed pulley.

A first cable has a first end securely attached to the arm exercising assembly and loops around the second fixed pulley, the third and fourth fixed pulley, the lower pulley of the first movable pulley pair, the upper pulley of the third movable pulley pair, and has a second end securely attached to a pulley yoke of the movable pulley.

A second cable has a first end securely attached to the upper subframe and loops around the upper pulley of the first movable pulley, the fifth fixed pulley, the upper pulley of the second movable pulley pair, and has a second end also securely attached to the upper subframe.

A third cable has a first end securely attached to the lower subframe and loops around the lower pulley of the second movable pulley pair, and has a second end securely attached to the resistance means.

A fourth cable has a first end securely attached to the lower subframe and loops around the lower pulley of the third movable pulley pair, the seventh fixed pulley, and has a second end securely attached to the leg exercising means.

A fifth cable has a first end securely attached to the chest exercising assembly and loops around one of the sixth fixed pulleys, the movable pulley, and then loops around the other sixth fixed pulley, and has a second end securely attached to chest exercising assembly.

Preferably, the movable pulley is at a level between the lower pulley of the first movable pulley pair and above the third fixed pulley, while the third movable pulley pair is at a level below the fourth fixed pulley.

In one embodiment of the invention, the leg exercising assembly includes an arcuate member pivotally attached to the seat and a leg exercising means fixedly mounted to a distal end of the arcuate member to move therewith, and the second end of the fourth cable is securely attached to the leg exercising means.

In accordance with one aspect of the invention, the universal gym further includes a lever-type strain gauge means mounted to the lower subframe, and an active pulley is provided between the lower movable pulley of the second movable pulley pair and the lever-type strain gauge means. A sixth cable has a first end securely attached to an end of a first arm of the lever-type strain gauge means and loops around the active pulley, and has a second end securely attached to the ground board.

Preferably, the lever-type strain gauge means includes a first arm securely mounted to the lower subframe, a strain gauge having a first end securely attached to the first arm and a second end, and a second arm having a first end attached to the second end of the strain gauge and a second end to which the first end of the sixth cable is securely attached.

It is a primary object of the present invention to provide a universal gym including a plurality of exercising assemblies the resultant resistances of which are identical.

It is another object of the present invention to provide a universal gym which has a lever-type strain gauge means to sense the force applied by an exerciser and a digital value thereof is displayed on a display.

Other objects, advantages, and novel features of the invention will become more apparent from the following detailed description when taken in conjunction with the accompanying drawings.

DESCRIPTION OF THE PREFERRED EMBODIMENT

Figure 1:
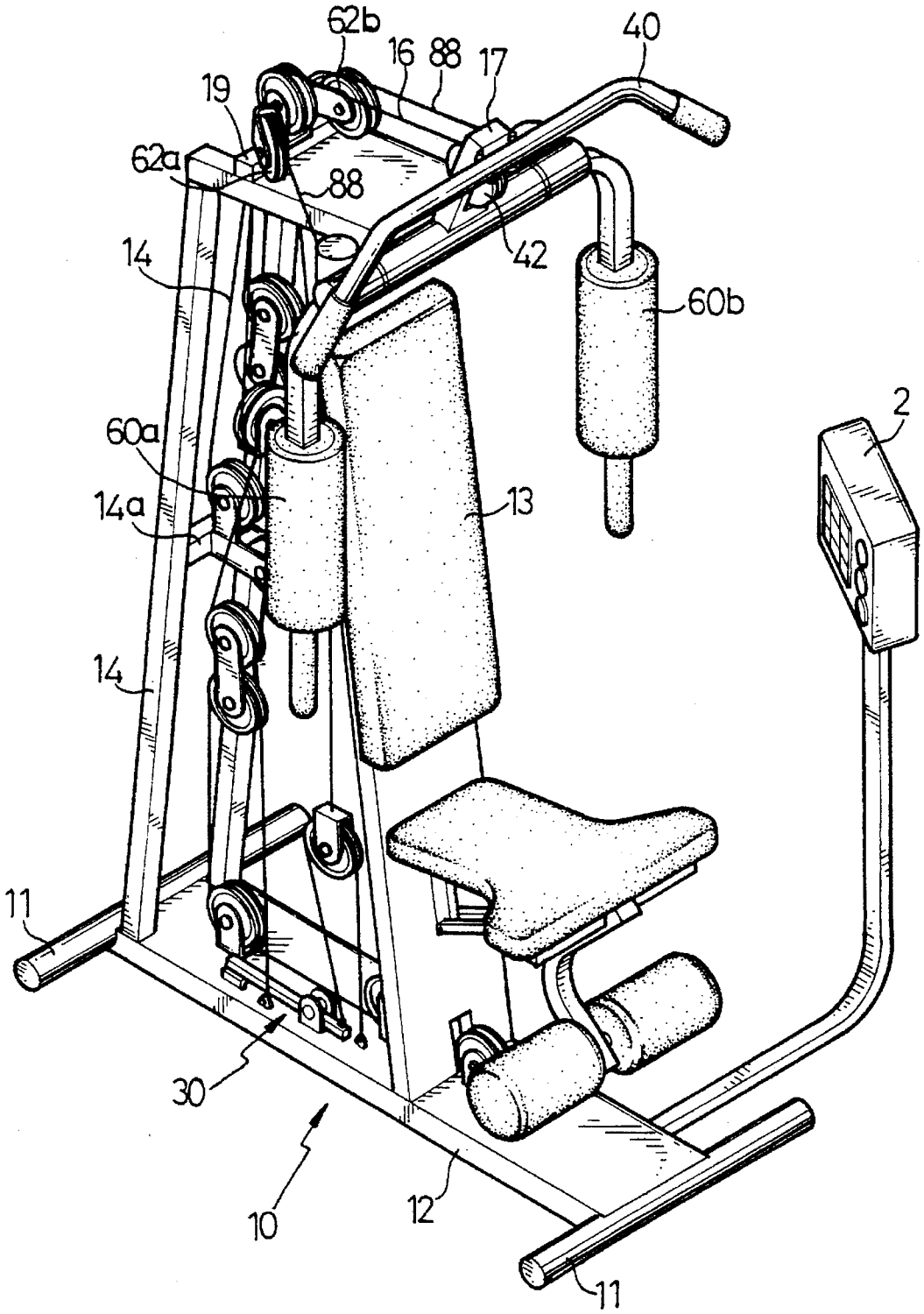
FIG. 1 is a perspective view of a universal gym in accordance with the present invention.
Figure 2:
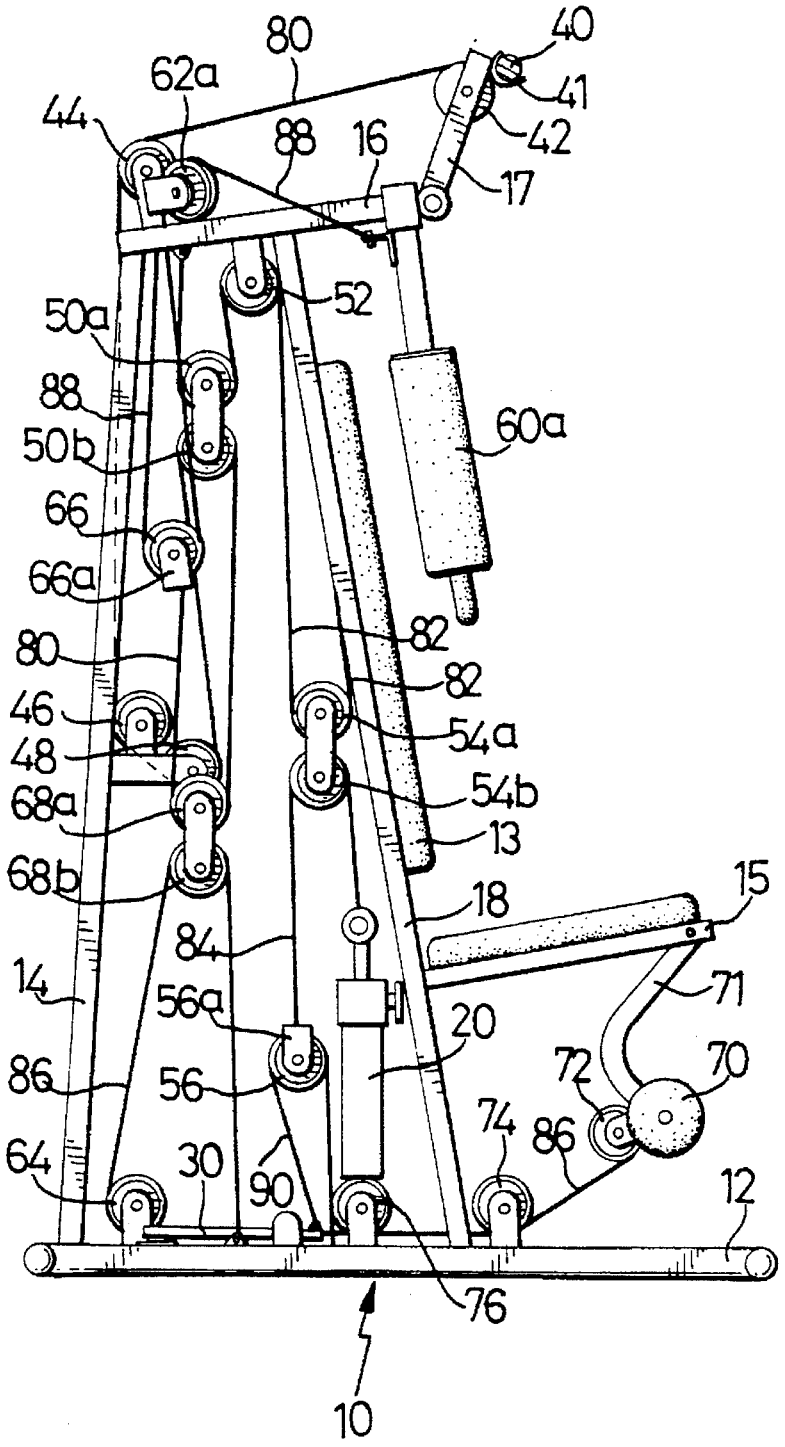
FIG. 2 is a left side elevational view of the universal gym in FIG. 1.

Referring to the drawings and initially to FIGS. 1 and 2, a universal gym in accordance with the present invention generally includes a frame assembly 10, a resistance assembly 20, a lever-type strain gauge means 30, and a plurality of exercising assemblies. The frame assembly 10 includes a lower subframe comprising a ground board 12, two spaced vertical beams 14 projecting upwardly from a first end of the ground board 12, an upper subframe including two spaced upper horizontal beams 16 each having a first end respectively fixedly attached to the upper end of the associated vertical beams 14 and a substantially inverted U-shaped member 17 interconnected between second ends of the upper horizontal beams 16, and an inclined board 18 having a lower end fixedly mounted to a mediate section of the ground board 12 and an upper end fixedly mounted to mediate sections of the upper horizontal beams 16. A cushion 13 is fixedly attached to an upper section of the inclined board 18, and a seat 15 is fixedly attached to a lower section of the inclined board 18. Preferably, the ground board 12 is made of metal to provide a stable construction. In addition, two rods 11 may be provided to two ends of the ground board 12 to further provide a stable construction. It is, nevertheless, appreciated that the illustrated frame assembly 10 is only for explanation purpose, i.e., the present universal gym may have a frame assembly of other types without departing the scope of the invention.

Still referring to FIGS. 1 and 2, a first fixed pulley 42 is securely mounted to the member 17 of the upper subframe of the frame assembly 10, a second fixed pulley 44 is securely mounted to a beam 19 (see FIG. 1) which, in turn, is mounted between the two upper horizontal beams 16, a third fixed pulley 46 and a fourth fixed pulley 48 are securely mounted to a beam **14*a* (see FIG. 1) which, in turn, is mounted between two mediate sections of the upright beams 14, and a fifth fixed pulley 52 is mounted to an underside of one of the upper horizontal beams 16**.

A first movable pulley pair comprising an upper movable pulley **50*a* and a lower movable pulley 50*b* is provided between the fourth fixed pulley 48 and the fifth fixed pulley 52. A second movable pulley pair comprising an upper movable pulley 54*a* and a lower movable pulley 54*b* is provided between the fifth fixed pulley 52 and the resistance means 20. An active pulley 56 is provided between the lower movable pulley 54*b* of the second movable pulley pair and the lever-type strain gauge means 30**.

A pair of sixth fixed pulleys **62*a*, 62*b* (see FIG. 1) are securely mounted to the beam 19 and respectively on both sides of the second fixed pulley 44. A seventh fixed pulley 64 is securely mounted to the ground board 12 and adjacent to the lever-type strain gauge means 30. A movable pulley 66 is provided between the sixth fixed pulleys 62*a* and the seventh fixed pulley 64. Preferably, the movable pulley 66 is at a level between the lower pulley 50*b* of the first movable pulley pair and above the third fixed pulley 46. A third movable pulley pair comprising an upper pulley 68*a* and a lower pulley 68*b* is provided between the movable pulley 66 and the seventh fixed pulley 64. Preferably, the third movable pulley pair is at a level below the fourth fixed pulley 48**.

A leg exercising assembly includes an arcuate member 71 pivotally attached to an underside of the seat 15 and a leg exercising means 70 fixedly mounted to a distal end of the arcuate member 71 to move therewith. A second movable pulley 72 is securely attached to the leg exercising means 70 to move therewith. A ninth fixed pulley 74 and a tenth fixed pulley 76 are mounted to the ground board 12, which will be discussed hereinafter.

A first cable 80 has a first end securely attached to an arm exercising assembly (such as a pull bar member 40) and loops around the second fixed pulley 44, the third and fourth fixed pulleys 46 and 48, the lower pulley **50*a* of the movable pulley pair, the upper pulley 68*a* of the third movable pulley pair, and has a second end securely attached to a pulley yoke 66*a* for the movable pulley 66. As clearly shown in FIG. 2, the third and fourth fixed pulleys 46 and 48 are arranged in a manner to change a direction of the first cable 80** which loops therethrough.

A second cable 82 has a first end securely attached to the upper subframe (e.g., one of the upper horizontal beams 16) and loops around the upper pulley **50*a* of the first movable pulley, the fifth fixed pulley 52, the upper pulley 54*a* of the second movable pulley pair, and has a second end also securely attached to the upper subframe (e.g., one of the upper horizontal beams 16). A third cable 84 has a first end securely attached to a pulley yoke 56*a* of the active pulley 56 and loops around the lower pulley 54*b* of the second movable pulley pair, and has a second end securely attached to the resistance means 20. A fourth cable 86 has a first end securely attached to the ground board 12 and loops around the lower pulley 68*b* of the third movable pulley pair, the seventh fixed pulley 64, the tenth and ninth fixed pulleys 76 and 74, and has a second end securely attached to the second movable pulley 72. Alternatively, the second movable pulley 72 may be omitted, and the second end of the fourth cable 86 is directly attached to the leg exercising means 70** of the leg exercising assembly.

A fifth cable 88 has a first end securely attached to one of a pair of chest exercising members **60*a* and loops around the associated sixth fixed pulley 62*a*, the movable pulley 66, and then loops around the other sixth fixed pulley 62*b*, and has a second end securely attached to the other chest exercising member 60*b*. A sixth cable 90 has a first end securely attached to an end of a second arm 34 of the lever-type strain gauge means 30 and loops around the active pulley 56, and has a second end securely attached to the ground board 12**.

Figure 6:
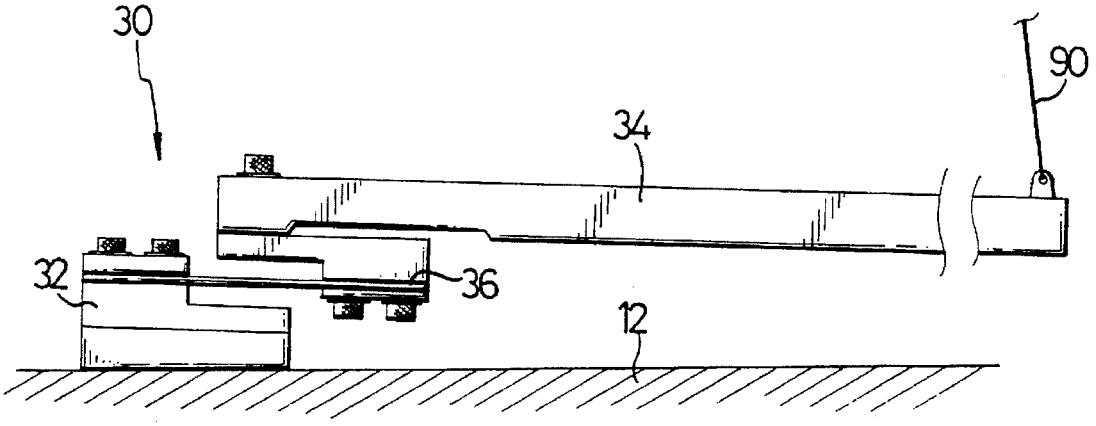
FIG. 6 is an enlarged view illustrating lever-type strain gauge means of the universal gym.

Referring to FIG. 6, the lever-type strain gauge means 30 includes a first arm 32, a second arm 34, and a strain gauge 36 provided between the first and second arms 32 and 34. As can be seen in FIG. 6, the first arm 32 is securely mounted to the ground board 12, and a first end of the strain gauge 36 is secured to the first arm 32. The second arm 34 includes a first end secured to a second end of the strain gauge 36 and a second end to which the first end of the sixth cable 90 is securely attached.

Figure 3:
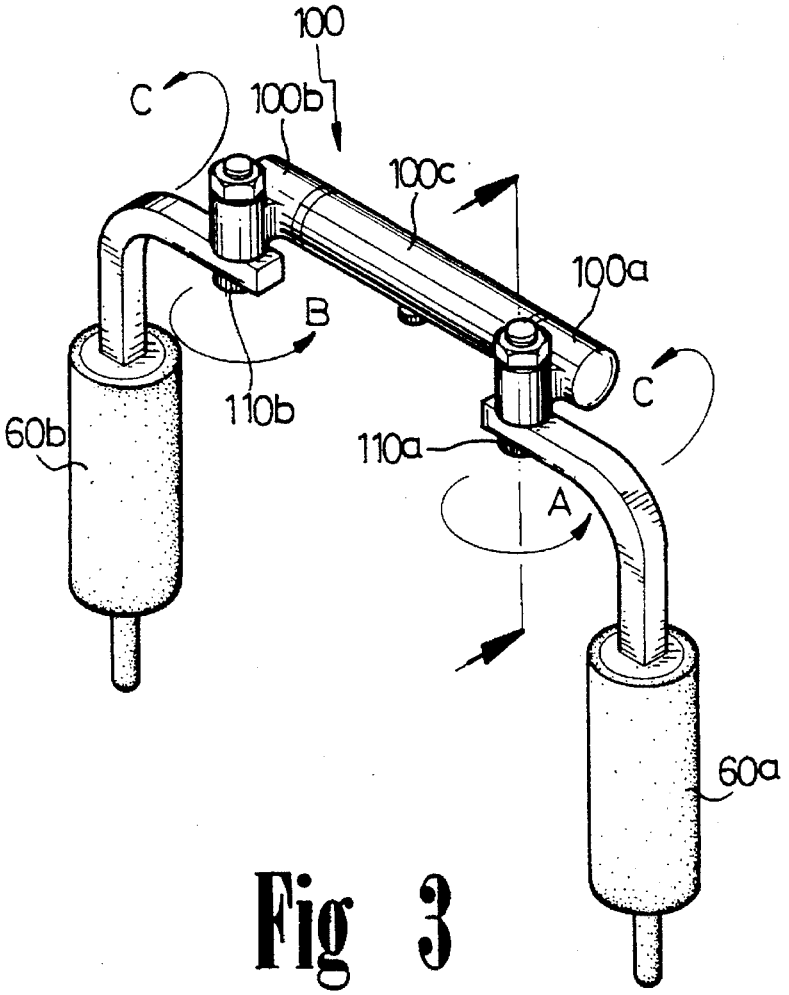
FIG. 3 is a perspective view illustrating a chest exercising assembly of the universal gym.
Figure 4:
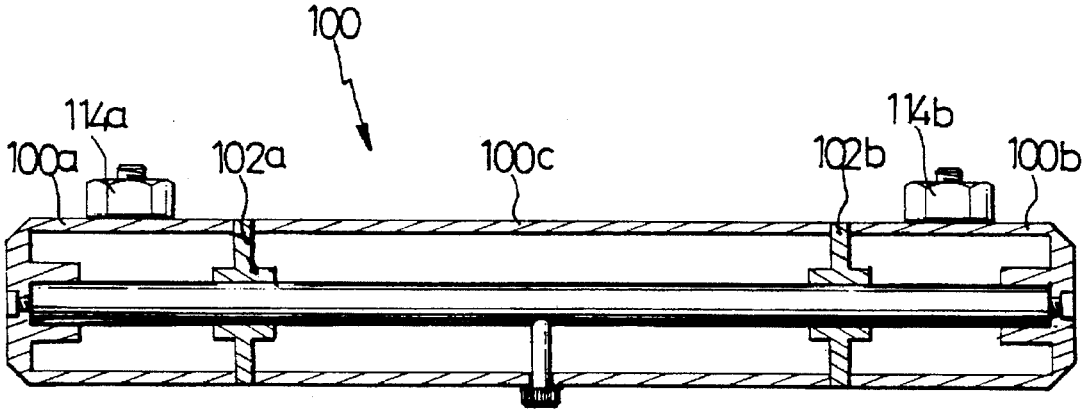
FIG. 4 is a cross-sectional view, taken along line 4—4 in FIG. 5, of a cylindrical member of the chest exercising assembly.

Referring now to FIGS. 3 and 4, in addition to the members **60*a* and 60*b*, the chest exercising assembly includes a substantially cylindrical member 100 comprising a fixed mediate section 100*c* and two end sections 100*a* and 100*b*** which are rotatable relative to the fixed mediate section 100*c* (in a direction indicated by arrow "C" in FIG. 3) by means of a bearing arrangement 102*a*, 102*b* (see FIG. 4) provided between the mediate section 100*b* and each of the end sections 100*a* and 100*b*. When exercising with the chest exercising assembly in the direction indicated by arrow "C", a safety pin 104 is inserted into the mediate section 100*c* to fix a longitudinal rod 106 therein, thereby preventing rotational movements of the rod 106 when proceeding with rotational movements of the end sections 100*a* and 100*b* relative to the mediate section 100*c*.

Figure 5:
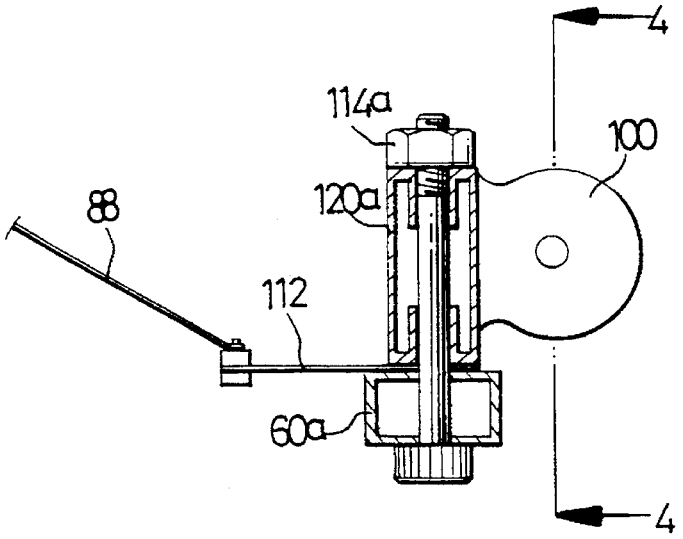
FIG. 5 is a partially sectioned side elevational view taken along line 5—5 in FIG. 3.

Still referring to FIGS. 3 and 4 and further to FIG. 5, the chest exercising assembly further includes a pair of attaching members 120*a* and 120*b* respectively fixedly attached to the end sections 100*a* and 100*b*. A pin 110*a* and a nut 114*a* are provided to attach an upper end of the associated member 60*a* to the attaching member 120*a* such that the member 60*a* is pivotable about an axis of the pin 110*a* in a direction indicated by arrow "A" in FIG. 3. Similarly, a second pin 110*b* and a second nut 114*b* are provided to attach an upper end of the associated member 60*b* to the attaching member 120*b* such that the member 60*b* is pivotable about an axis of the pin 110*b* in a direction indicated by arrow "B" in FIG. 3. It is appreciated that an extension plate 112 is securely attached to each of the members 60*a* and 60*b* at a first end thereof, and the first end of the fifth cable 88 is securely attached to a second end of the extension plate 112 while the second end of the fifth cable 88 is securely attached to a second end of the other extension plate (not shown) which, in turn, is securely attached to the member 60*b*. Accordingly, pivotal movements of the members 60*a* and 60*b* in the directions indicated by arrows "A", "B" and "C" cause movement of the fifth cable 88.

Figure 7:
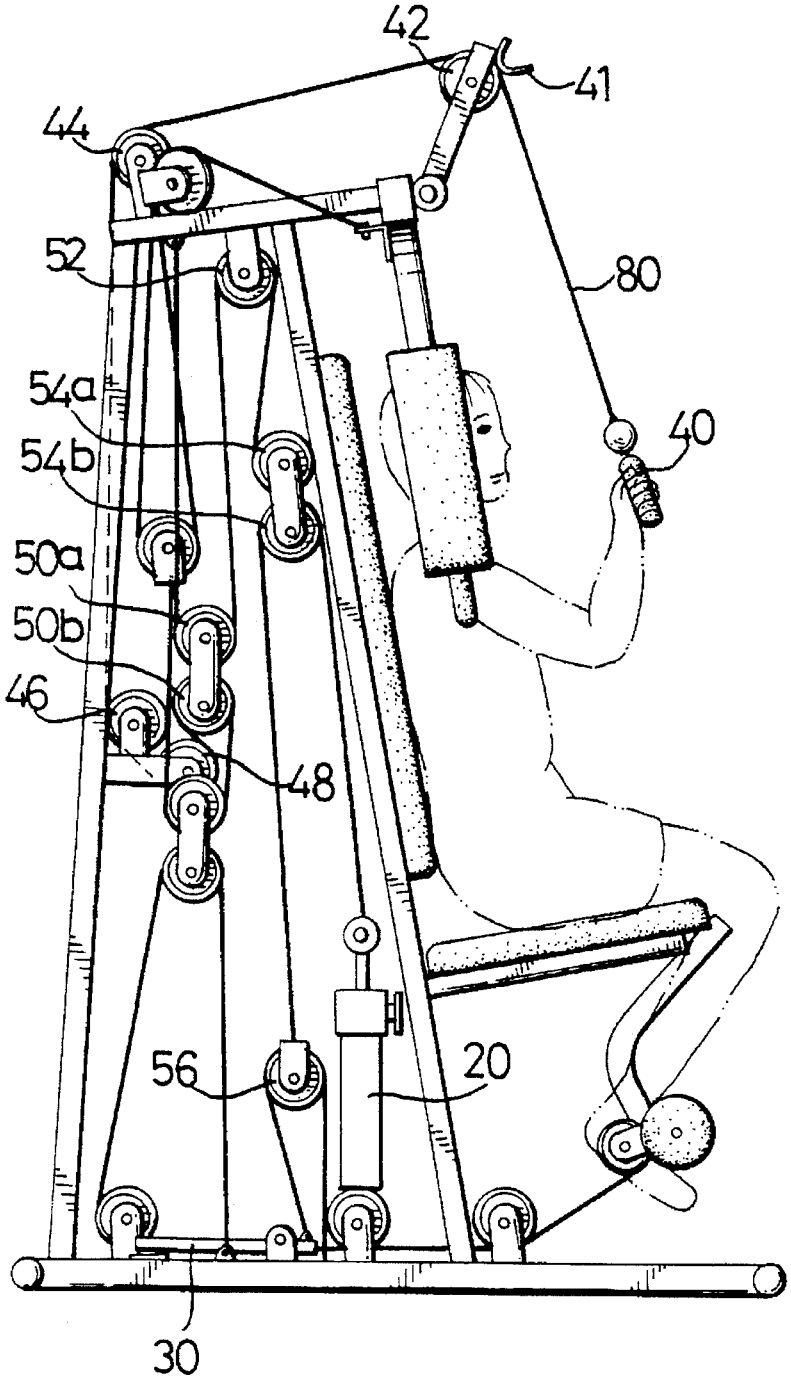
FIGS. 7 to 9 are side elevational views illustrating operations of the universal gym.
Figure 8:
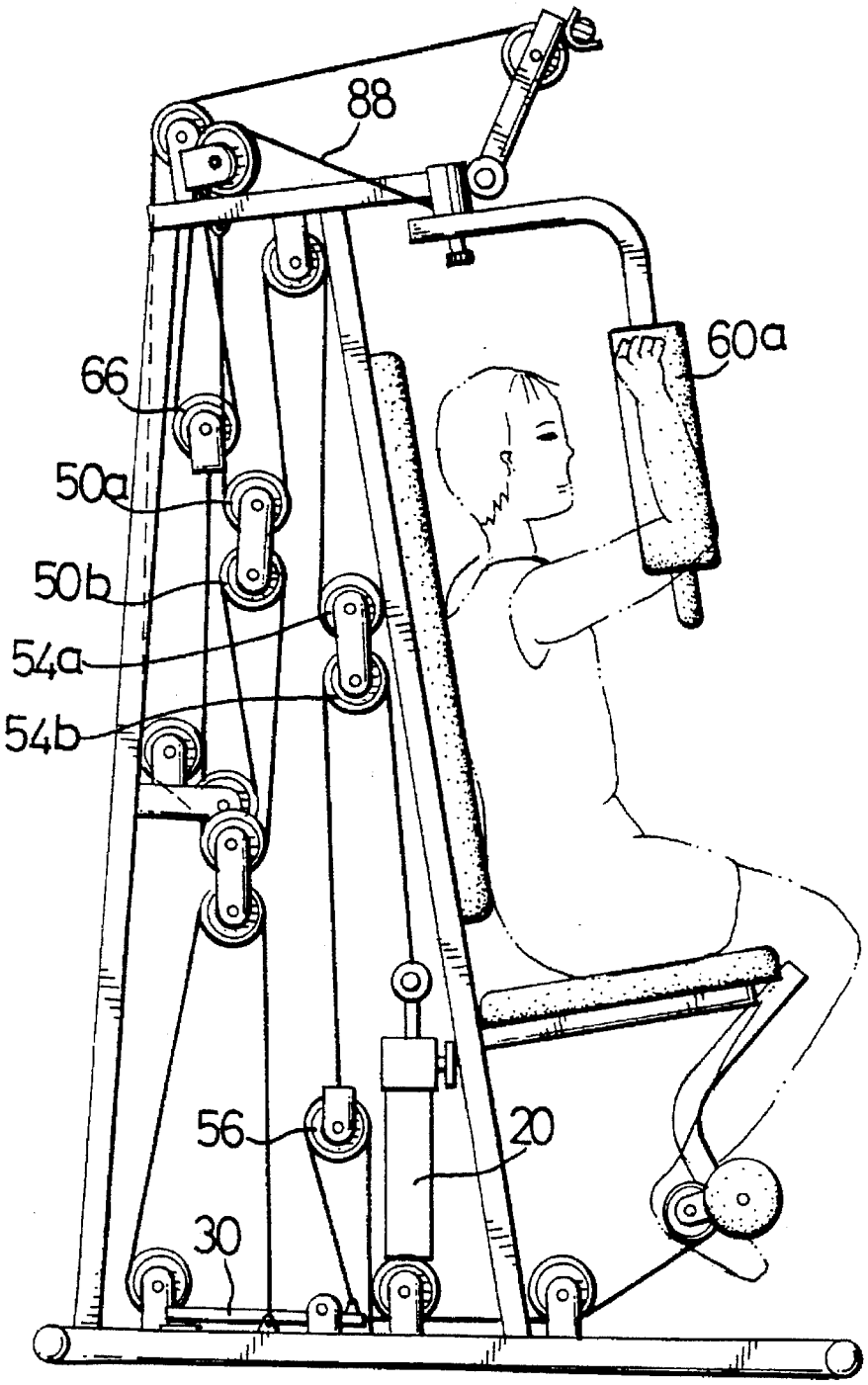
Figure 9:
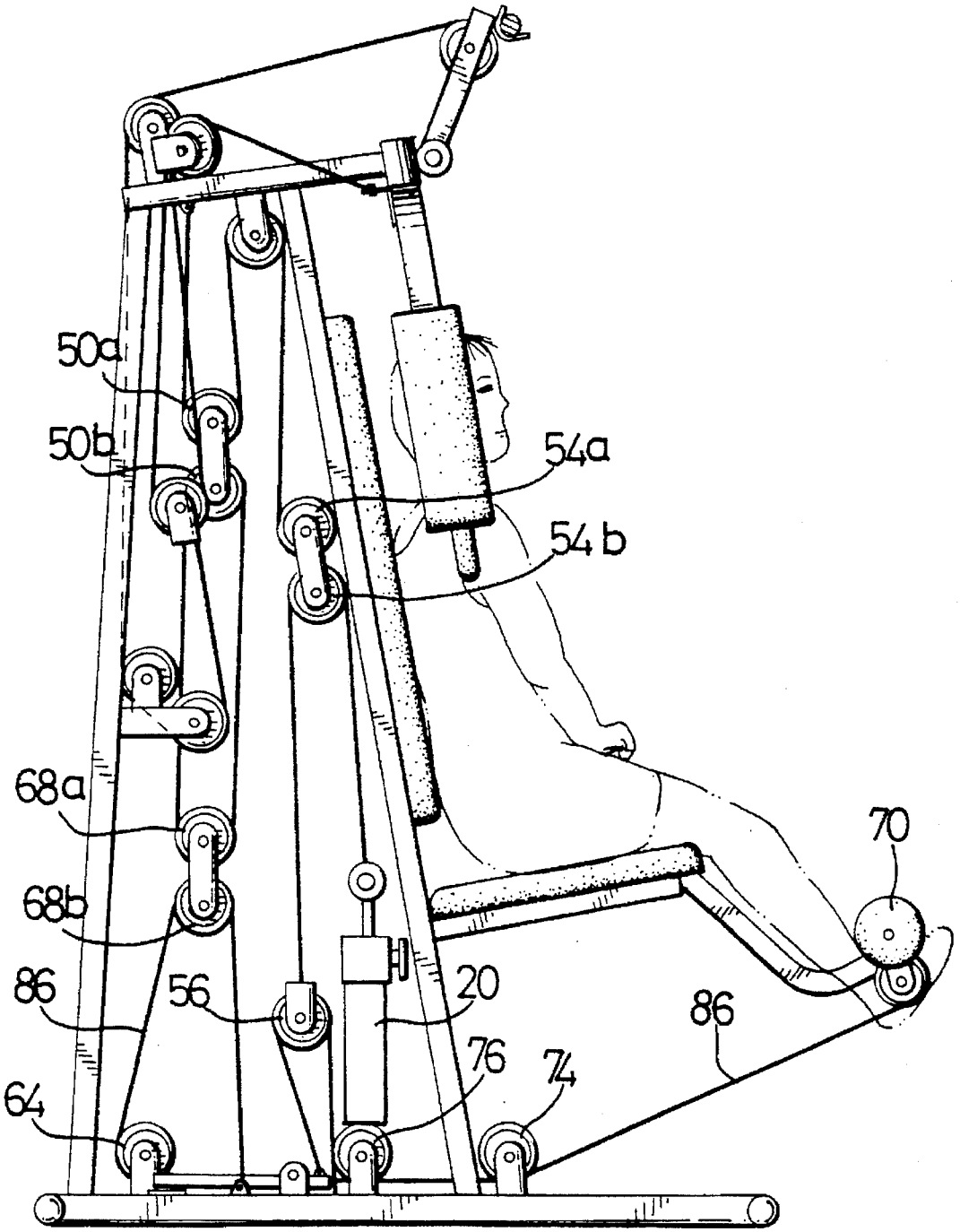
Figure 10:
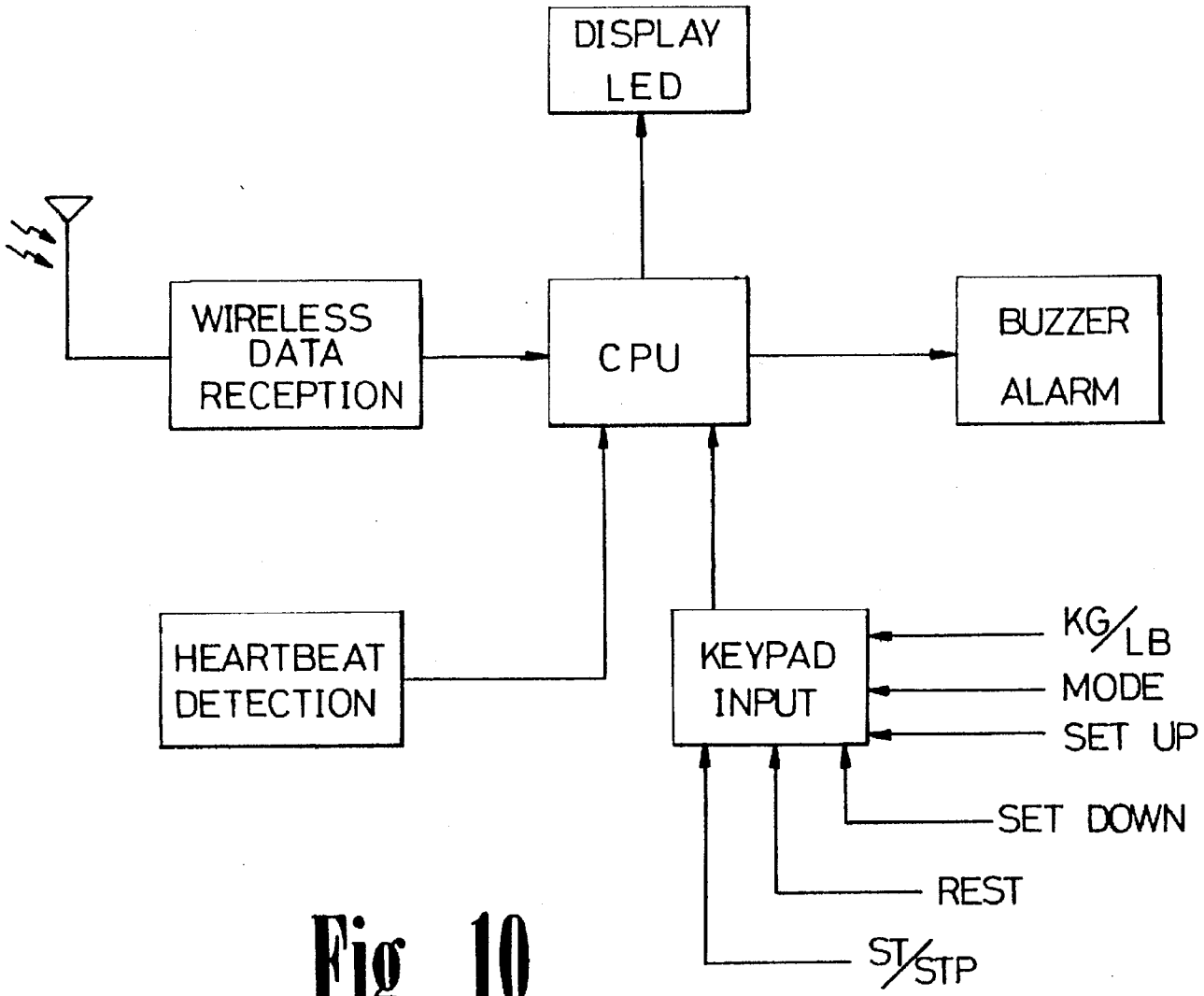
FIG. 10 is a block diagram illustrating an electrical control means of the universal gym.

Referring now to FIGS. 7 to 9 and initially to FIG. 7, the pull bar 40 rests on a support 41 when not in use (see FIG. 2), and when the user pulls the pull bar downwardly, the cable 80 is moved downwardly, which, in turn, causes downward movements of the movable pulley pair 50*a* and 50*b* as well as upward movements of the movable pulley pair 54*a* and 54*b*. As the second end of cable 84 is attached to the resistance means 20, the user must apply a force against a resistance provided by the resistance means 20. In this embodiment, the resistance means 20 is a hydraulic cylinder with variable resistances. It is, nevertheless, appreciated that resistance means with variable resistances of other types may be used. The first end of cable 90 is attached to the lever-type strain gauge means 30 (see FIG. 6) such that a magnitude of force applied by the user is detected, and a digital value is displayed on a display means 2 (see FIG. 1). FIG. 10 of the drawings illustrate a typical block diagram for detecting some data (such as heartbeats, magnitude of applied forces, etc.) and for setting up the resistance, etc., which are conventional and beyond the scope of the invention and are therefore not further described.

Referring now to FIG. 8, when the user moves the chest exercising unit 60*a* and 60*b* from a position shown in FIG. 2 to another position shown in FIG. 8, the members 60*a* and 60*b* respectively rotate in directions "A"and "B" (see FIG. 3) and causes movement of the cable 88, which, in turn, causes upward movement of the pulley 66, downward movements of the movable pulley pair 50*a* and 50*b*, as well as upward movements of the movable pulley pair 54*a* and 54*b*. Again, the user has to apply a force against the resistance provided by the resistance means 20 and such a force is detected by the lever-type strain gauge means 30. Although not illustrated, the user may rotate the members 60*a* and 60*b* in a direction indicated by arrow "C" (see FIG. 3), which also causes the movement of the cable 88 and subsequent movements of the pulleys, which are identical to those occurred when the members 60*a* and 60*b* are rotated in the directions indicated by arrows "A" and "B" such that a further description is not required to avoid redundancy.

Referring now to FIG. 9, when the user moves the leg exercising means 70 from a position shown in FIG. 2 to another position shown in FIG. 9, the leg exercising means 70 is pivoted and thus causes movement of the cable 86, which, in turn, causes downward movement of movable pulley pair 68*a* and 68*b*, downward movements of the movable pulley pair 50*a* and 50*b*, as well as upward movements of the movable pulley pair 54*a* and 54*b*. Again, the user has to apply a force against the resistance provided by the resistance means 20 and such a force is detected by the lever-type strain gauge means 30.

It is found that, when the user operates different exercising assemblies, the resultant resistances thereof are the same, i.e., the resultant resistances at the pull bar 40, the chest exercising members 60*a* and 60*b*, and the leg exercising means 70 are identical. It is achieved by the overall arrangement of all of the pulleys. Accordingly, inadvertent injury to the users during use of the universal gym is prevented as the user is subjected to "uniform" resistance in all of the exercising units. It is appreciated that the lever-type strain gauge means 30 is an important feature of the invention, as it is not disclosed in the prior art universal gyms for detection of the force applied. In an alternate embodiment of the invention, the lever-type strain gauge means 30, the active pulley 56, and the fifth cable 90 may be omitted, and the first end of the third cable 84 is directly attached to the ground board 12.

Although the invention has been explained in relation to its preferred embodiment, it is to be understood that many other possible modifications and variations can be made without departing from the spirit and scope of the invention as hereinafter claimed.

What is claimed is:

1. A universal gym comprising:

a frame assembly (10), a resistance means (20), and a plurality of exercising assemblies including an arm exercising assembly (40), a chest exercising assembly, and a leg exercising assembly;

the frame assembly (10) comprising a lower subframe (12), two spaced vertical beams (14) projecting upwardly from the lower subframe (12) and each having a top and a mediate section, and an upper subframe securely mounted to the tops of the vertical beams and having an upper side and a lower side, an inclined board (18) being mounted between the lower subframe and the upper subframe and having a lower section, a seat (15) being fixedly attached to the lower section of the inclined board (18);

a first fixed pulley (42) securely mounted to the upper side of the upper subframe and adjacent to the arm exercising assembly;

a second fixed pulley (44) securely mounted to the upper side of the upper subframe and distal to the arm exercising assembly;

a third fixed pulley (46) and a fourth fixed pulley (48) securely mounted between the mediate sections of the upright beams (14);

a fifth fixed pulley (52) mounted to the underside of the upper subframe and between the first and second fixed pulleys (42 and 44);

a first movable pulley pair comprising an upper movable pulley (50*a*) and a lower movable pulley (50*b*) and provided between the fourth fixed pulley (48) and the fifth fixed pulley (52);

a second movable pulley pair comprising an upper movable pulley (54*a*) and a lower movable pulley (54*b*) provided between the fifth fixed pulley (52) and the resistance means (20);

a pair of sixth fixed pulleys (62*a*, 62*b*) securely mounted to the upper side of the upper subframe and respectively on both sides of the second fixed pulley (44);

a seventh fixed pulley (64) securely mounted to the lower subframe (12);

a movable pulley (66) with a pulley yoke (66*a*) provided between the sixth fixed pulleys (62*a*) and the seventh fixed pulley (64);

a third movable pulley pair comprising an upper pulley (68*a*) and a lower pulley (68*b*) provided between the movable pulley (66) and the seventh fixed pulley (64);

a first cable (80) having a first end securely attached to the arm exercising assembly (40) and looping around the second fixed pulley (44), the third and fourth fixed pulley (46 and 48), the lower pulley (50*a*) of the first movable pulley pair, the upper pulley (68*a*) of the third movable pulley pair, and having a second end securely attached to the pulley yoke (66*a*) of the movable pulley (66);

a second cable (82) having a first end securely attached to the upper subframe and looping around the upper pulley (50*a*) of the first movable pulley, the fifth fixed pulley (52), the upper pulley (54*a*) of the second movable pulley pair, and having a second end also securely attached to the upper subframe;

a third cable (84) having a first end securely attached to the lower subframe (12) and looping around the lower pulley (54*b*) of the second movable pulley pair, and having a second end securely attached to the resistance means (20);

a fourth cable (86) having a first end securely attached to the lower subframe (12) and looping around the lower pulley (68*b*) of the third movable pulley pair, the seventh fixed pulley (64), and having a second end securely attached to the leg exercising assembly; and a fifth cable (88) having a first end securely attached to the chest exercising assembly and looping around one of the sixth fixed pulleys (62*a*), the movable pulley (66), and then looping around the other sixth fixed pulley (62*b*), and having a second end securely attached to the chest exercising assembly.

2. The universal gym as claimed in claim 1, wherein the movable pulley (66) is at a level between the lower pulley (50*b*) of the first movable pulley pair and above the third fixed pulley (46).

3. The universal gym as claimed in claim 1, wherein the third movable pulley pair (68*a*, 68*b*) is at a level below the fourth fixed pulley (48).

4. The universal gym as claimed in claim 1, wherein the leg exercising assembly includes an arcuate member (71) pivotally attached to the seat (15) and a leg exercising means (70) fixedly mounted to a distal end of the arcuate member (71) to move therewith, and the second end of the fourth cable (86) is securely attached to the leg exercising means (70).

5. A universal gym comprising:

a frame assembly (10), a resistance means (20), a lever-type strain gauge assembly (30), and a plurality of exercising assemblies including an arm exercising assembly (40), a chest exercising assembly, and a leg exercising assembly;

the frame assembly (10) comprising a lower subframe (12) on which the lever-type strain gauge means (30) is mounted, two spaced vertical beams (14) projecting upwardly from the lower subframe (12) and each having a top, and an upper subframe securely mounted to the tops of the vertical beams and having an upper side and a lower side and a mediate section, an inclined board (18) being mounted between the lower subframe and the upper subframe and having a lower section, a seat (15) being fixedly attached to the lower section of the inclined board (18);

a first fixed pulley (42) securely mounted to the upper side of the upper subframe and adjacent to the arm exercising assembly (40);

a second fixed pulley (44) securely mounted to the upper side of the upper subframe and distal to the arm exercising assembly;

a third fixed pulley (46) and a fourth fixed pulley (48) securely mounted between the mediate sections of the upright beams (14);

a fifth fixed pulley (52) mounted to the underside of the upper subframe and between the first and second fixed pulleys (42 and 44);

a first movable pulley pair comprising an upper movable pulley (50*a*) and a lower movable pulley (50*b*) and provided between the fourth fixed pulley (48) and the fifth fixed pulley (52);

a second movable pulley pair comprising an upper movable pulley (54*a*) and a lower movable pulley (54*b*) provided between the fifth fixed pulley (52) and the resistance means (20);

an active pulley (56) with a pulley yoke (56*a*) provided between the lower movable pulley (54*b*) of the second movable pulley pair and the lever-type strain gauge means (30);

pair of sixth fixed pulleys (62*a*, 62*b*) securely mounted to the upper side of the upper subframe and respectively on both sides of the second fixed pulley (44);

a seventh fixed pulley (64) securely mounted to the lower subframe (12) and adjacent to the lever-type strain gauge means (30);

a movable pulley (66) with a pulley yoke (66*a*) provided between the sixth fixed pulleys (62*a*) and the seventh fixed pulley (64), the movable pulley (66) being at a level between the lower pulley (50*b*) of the first movable pulley pair and above the third fixed pulley (46);

a third movable pulley pair comprising an upper pulley (68*a*) and a lower pulley (68*b*) provided between the movable pulley (66) and the seventh fixed pulley (64), the third movable pulley pair (68*a*, 68*b*) being at a level below the fourth fixed pulley (48);

a first cable (80) having a first end securely attached to the arm exercising assembly (40) and looping around the second fixed pulley (44), the third and fourth fixed pulley (46 and 48), the lower pulley (50*a*) of the first movable pulley pair, the upper pulley (68*a*) of the third movable pulley pair, and having a second end securely attached to the pulley yoke (66*a*) of the movable pulley (66);

a second cable (82) having a first end securely attached to the upper subframe and looping around the upper pulley (50*a*) of the first movable pulley, the fifth fixed pulley (52), the upper pulley (54*a*) of the second movable pulley pair, and having a second end also securely attached to the upper subframe;

a third cable (84) having a first end securely attached to the pulley yoke (56*a*) of the active pulley (56) and looping around the lower pulley (54*b*) of the second movable pulley pair, and having a second end securely attached to the resistance means (20);

a fourth cable (86) having a first end securely attached to the lower subframe (12) and looping around the lower pulley (68*b*) of the third movable pulley pair, the seventh fixed pulley (64), and having a second end securely attached to the leg exercising means;

a fifth cable (88) having a first end securely attached to the chest exercising assembly and looping around one of the sixth fixed pulleys (62*a*), the movable pulley (66), and then looping around the other sixth fixed pulley (62*b*), and having a second end securely attached to the chest exercising assembly; and a sixth cable (90) having a first end securely attached to the lever-type strain gauge means (30) and looping around the active pulley (56), and having a second end securely attached to the lower subframe (12).

6. The universal gym as claimed in claim 5, wherein the lever-type strain gauge means (30) includes a first arm (32) securely mounted to the lower subframe (12), a strain gauge (36) having a first end securely attached to the first arm (32) and a second end, and a second arm (34) having a first end attached to the second end of the strain gauge (36) and a second end to which the first end, of the sixth cable (90) is securely attached.

7. The universal gym as claimed in claim 5, wherein the leg exercising assembly includes an arcuate member (71) pivotally attached to the seat (15) and a leg exercising means (70) fixedly mounted to a distal end of the arcuate member (71) to move therewith, and the second end of the fourth cable (86) is securely attached to the leg exercising means (70).

* * * * *